US011268744B2

(12) United States Patent
Crowe et al.

(10) Patent No.: US 11,268,744 B2
(45) Date of Patent: Mar. 8, 2022

(54) REFRIGERATION SYSTEM AND METHOD OF REFRIGERATION LOAD CONTROL

(71) Applicant: Hussmann Corporation, Bridgeton, MO (US)

(72) Inventors: Quentin Crowe, Duluth, GA (US); Carlton Hardie, Buford, GA (US); Justin Thomas, Marietta, GA (US); Kuntady Poornaprajna, Suwanee, GA (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 16/758,904

(22) PCT Filed: Feb. 1, 2018

(86) PCT No.: PCT/US2018/016525
§ 371 (c)(1),
(2) Date: Apr. 24, 2020

(87) PCT Pub. No.: WO2019/083558
PCT Pub. Date: May 2, 2019

(65) Prior Publication Data

US 2021/0180844 A1 Jun. 17, 2021

Related U.S. Application Data

(60) Provisional application No. 62/576,420, filed on Oct. 24, 2017.

(51) Int. Cl.

| | |
|---|---|
| ***F25B 49/02*** | (2006.01) |
| ***F25B 41/22*** | (2021.01) |
| ***F25B 5/02*** | (2006.01) |

(52) U.S. Cl.
CPC ..... *F25B 49/02* (2013.01); *F25B 5/02* (2013.01); *F25B 41/22* (2021.01);
(Continued)

(58) Field of Classification Search
CPC .... F25B 49/02; F25B 41/22; F25B 2400/061; F25B 2400/075; F25B 2400/0751; F25B 2700/1933
See application file for complete search history.

(56) References Cited

U.S. PATENT DOCUMENTS

| | | |
|---|---|---|
| 2012/0167601 A1 | 7/2012 | Cogswell et al. |
| 2013/0177393 A1 | 7/2013 | Sishtla |

(Continued)

OTHER PUBLICATIONS

International Search Report and Written Opinion for Application No. PCT/US2018/016525 dated Jul. 19, 2018 (12 pages).

*Primary Examiner* — Jonathan Bradford
(74) *Attorney, Agent, or Firm* — Michael Best & Friedrich LLP

(57) ABSTRACT

A method of controlling a refrigeration system including a medium temperature refrigeration load and a low temperature refrigeration load. The method includes selectively bypassing refrigerant between a medium temperature suction group and a low temperature suction group via a bypass line using an electronic valve positioned in the bypass line. The method also includes controlling flow of refrigerant between the medium temperature suction group and the low temperature suction group via a controller communicatively coupled to the valve, and modulating the valve at any position between a closed position and a full open position to vary an amount of refrigerant flow between the medium temperature suction group and the low temperature suction group in response to determining, via the controller, one or both of a state of the medium temperature suction group and a state of the low temperature suction group.

16 Claims, 4 Drawing Sheets

(52) U.S. Cl.
CPC ..... *F25B 2400/061* (2013.01); *F25B 2600/05* (2013.01); *F25B 2600/2515* (2013.01); *F25B 2700/04* (2013.01); *F25B 2700/1933* (2013.01)

(56) References Cited

U.S. PATENT DOCUMENTS

| | | | | |
|---|---|---|---|---|
| 2016/0102901 | A1* | 4/2016 | Christensen ..... | F25B 49/022 62/117 |
| 2017/0205120 | A1 | 7/2017 | Ali et al. | |
| 2017/0241690 | A1 | 8/2017 | Groshek | |
| 2017/0321941 | A1 | 11/2017 | Fredslund et al. | |

* cited by examiner

REFRIGERATION SYSTEM AND METHOD OF REFRIGERATION LOAD CONTROL

CROSS-REFERENCE TO RELATED APPLICATIONS

This application claims priority to U.S. Provisional Application No. 62/576,420 filed Oct. 24, 2017, the entire contents of which are hereby incorporated by reference.

BACKGROUND

The present invention relates to a refrigeration system and, more specifically, to a method of controlling the refrigeration load of the refrigeration system.

Refrigeration systems are well known and widely used in supermarkets, warehouses, and elsewhere to refrigerate product that is supported in a refrigerated space. Conventional refrigeration systems include a heat exchanger or evaporator, a compressor, and a condenser. The evaporator provides heat transfer between a refrigerant flowing within the evaporator and a fluid (e.g., water, air, etc.) passing over or through the evaporator. The evaporator transfers heat from the fluid to the refrigerant to cool the fluid. The refrigerant absorbs the heat from the fluid and evaporates in a refrigeration mode, during which the compressor mechanically compresses the evaporated refrigerant from the evaporator and feeds the superheated refrigerant to the condenser, which cools the refrigerant. From the condenser, the cooled refrigerant is typically fed through an expansion valve to reduce the temperature and pressure of the refrigerant, and then the refrigerant is directed through the evaporator.

Often, retail settings also include one or more enclosed spaces (e.g., open or enclosed merchandisers, walk-in coolers, freezers, etc.) that must be cooled or refrigerated at different temperatures. Some retail settings employ mechanical subcooling in the refrigeration system to cool refrigerant in one portion of the refrigerant circuit using the same refrigerant in another portion of the refrigerant circuit. In these retail settings, liquid refrigerant in one area of the refrigerant circuit is cooled to approximately 50 degrees Fahrenheit by refrigerant from another portion of the same refrigerant circuit before being fed to low temperature loads in the retail setting.

Some existing refrigeration systems include medium temperature and low temperature compressor assemblies that are arranged in parallel with each other to condition separate refrigeration loads. In these systems, a check valve can be installed between the low temperature suction header and the medium temperature suction header. If the low temperature suction header pressure rises to a certain pressure (e.g., due to compressor failure) then the check valve will allow flow from the low temperature suction header to the medium temperature header. This will allow some level of refrigeration to the low temperature circuits at a higher pressure than normal. However, these existing systems cannot actively monitor the low temperature compressor for failure, and do not modify or adjust the medium temperature circuits to accommodate the shift in refrigeration to the low temperature circuits. More specifically, these mechanically-controlled systems cannot adjust or control the setpoints for the medium temperature suction group, and can cannot modulate the amount of refrigerant mass flow to the medium temperature suction group. In addition, existing mechanically-controlled systems do not have the capability to disable the mode in which refrigerant flow is shifted between the medium and low temperature suction groups.

Control systems for commercial refrigeration systems generally control cooling capacity in response to variations in refrigeration load. Often this involves on/off control of fixed speed compressors and/or variable control of variable speed compressors. When multiple compressors in a parallel arrangement are used to provide refrigerant to multiple evaporators operating at varying temperatures, suction pressure is generally used as a control variable input to the control system. Often a controller, implementing a proportional-integral-derivative control algorithm, processes a sensed suction pressure common to all the compressors in the parallel arrangement and determines a control output for one or more compressors to maintain cooling capacity at a level that closely matches the refrigeration load presented by the evaporators.

Some existing refrigeration systems have a mechanical pressure regulating valve installed between the low temperature suction group and the medium temperature group. This mechanical pressure regulating valve attempts to maintain a predetermined pressure in the low temperature suction header and constantly allows refrigerant to flow from the medium temperature suction header to low temperature suction header.

Another existing mechanical system includes a hot gas bypass valve positioned between the compressor discharge and the suction and hot gas bypass line to add a false load to the low temperature compressor to force the compressor to run. A disadvantage of this type of system is that the system is not controlled and will continue to bypass refrigerant to the low temperature compressor at times when not required.

Still other systems attempt to control the flow of refrigerant between low and medium temperature suction groups by adding additional compressors to provide capacity staging on the medium temperature suction group, but this setup disadvantageously incorporates more complex control associated with the added compressors and does not effectively manage the load on the low temperature suction group. In addition, adding compressors does not provide for load shedding or management of refrigerant capacity between the different medium temperature compressors.

SUMMARY OF THE INVENTION

The invention provides in one aspect, a refrigeration system including a medium temperature refrigeration load, a low temperature refrigeration load, a medium temperature suction group including a suction header and at least one medium temperature compressor, a low temperature suction group including a suction header and at least one low temperature compressor, a bypass line positioned between and selectively fluidly connected to the medium temperature suction group and the low temperature suction group, and an electronic valve positioned in the bypass line. A controller is in communication with the electronic valve to control the position of the valve between a closed position and a full open position, wherein control of the electronic valve selectively provides refrigerant flow between the medium temperature suction group and the low temperature suction group.

In another aspect, the invention provides a method of controlling a refrigeration system including a medium temperature refrigeration load and a low temperature refrigeration load, the refrigeration system further including a medium temperature suction group including a suction header and at least one medium temperature compressor, and a low temperature suction group including a suction header and at least one low temperature compressor. The method includes selectively bypassing refrigerant between the medium temperature suction group and the low temperature suction group via a bypass line using an electronic valve positioned in the bypass line, and controlling a flow of refrigerant between the medium temperature suction group and the low temperature suction group to maintain minimum run time for the low temperature compressor, emergency redundant control, or incremental staging capacity for the medium temperature compressor.

Other features and aspects of the invention will become apparent by consideration of the following detailed description and accompanying drawings.

Figure 1:
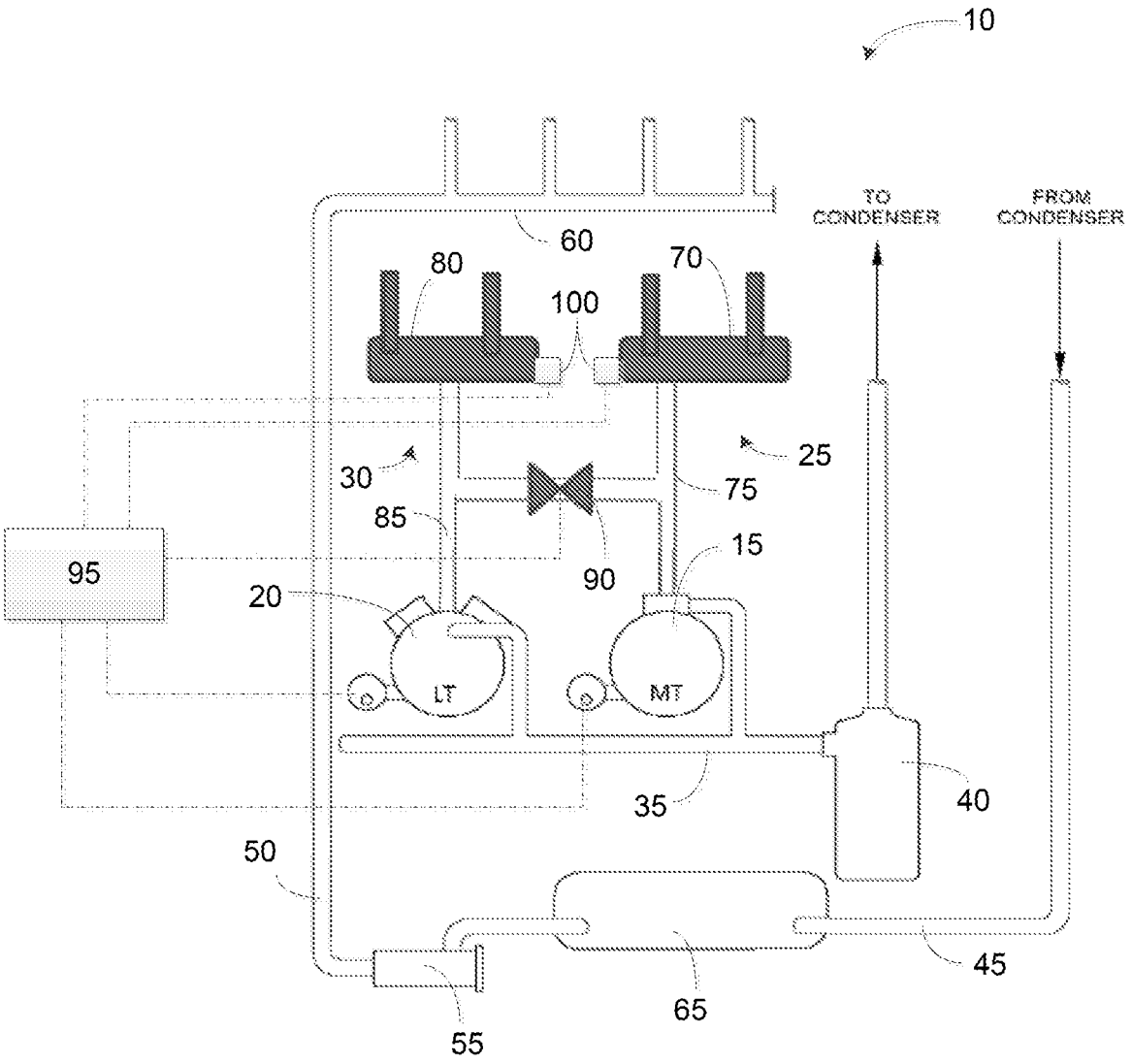
FIG. 1 is a schematic view of an exemplary refrigeration system embodying the invention.

Before any embodiments of the present invention are explained in detail, it should be understood that the invention is not limited in its application to the details or construction and the arrangement of components as set forth in the following description or as illustrated in the drawings. The invention is capable of other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

FIG. 1 illustrates an exemplary refrigeration system 10 that circulates a refrigerant to condition several interior spaces (e.g., product display areas of medium temperature merchandisers and low temperature merchandisers). As shown, the refrigeration system 10 includes a medium temperature ("MT") compressor assembly 15 and a low temperature ("LT") compressor assembly 20 that circulate refrigerant through the refrigeration system 10. In an exemplary embodiment, the MT compressor assembly 15 can include one or more compressors, and is associated and in communication with one or more medium temperature display cases (not shown) via a medium temperature suction main 25. The LT compressor assembly 20 can include one or more compressors (e.g., fixed capacity scrolls or other types of compressors) and is associated and in fluid communication with one or more low temperature display cases via a low temperature suction main 30.

Each of the medium and LT compressor assemblies 15, 20 is coupled to a discharge header 35, which is fluidly coupled to a condenser assembly (not shown) directly or through a separator 40. As is well known, the condenser assembly includes one or more condensers and exchanges heat from the refrigerant circulating through the condenser with another environment (e.g., an ambient environment) to cool the refrigerant. Each condenser includes a condenser coil and receives a flow of fluid (e.g., air or liquid) to cool the refrigerant. The condenser assembly can be located on a rooftop of a commercial setting, or elsewhere, to discharge energy from the refrigerant in the refrigerant system to the outside, ambient environment.

The refrigeration system 10 also includes a receiver line 45 and a fluid main or liquid line 50 that is fluidly coupled to a liquid header 60. The receiver line 45 is in fluid communication with the condenser assembly and a receiver 65 to direct cooled refrigerant from the condenser assembly to the receiver 65. The fluid main 50 is in fluid communication with the receiver 65 and the medium and low temperature display cases via the liquid header 60 to direct cooled refrigerant to respective evaporators in the display cases. While FIG. 1 illustrates a filter-drier 55 in the fluid main 50, it may be omitted from the refrigeration system 10 in some examples.

The evaporator(s) of the medium temperature display cases are fluidly coupled to the MT compressor assembly 15 via the medium temperature suction main 25. The medium temperature suction main 25 includes a medium temperature suction header 70 (e.g., accumulator) and a medium temperature suction line 75 that is disposed downstream of the medium temperature suction header 70 to direct refrigerant to the MT compressor assembly 15. The medium temperature suction line 75 fluidly interconnects the medium temperature suction header 70 and the MT compressor assembly 15. The evaporator(s) of the low temperature display cases are fluidly coupled to the LT compressor assembly 20 via the low temperature suction main 30. The low temperature suction main 30 includes a low temperature suction header 80 (e.g., accumulator) and a low temperature suction line 85 that is disposed downstream of the low temperature suction header 80 to direct refrigerant to the LT compressor assembly 20. The low temperature suction line 85 fluidly interconnects the low temperature suction header 80 and the LT compressor assembly 20. For purposes of description, the medium temperature suction header 70, the suction line 75, and the compressor assembly 15 will be referred to as the medium temperature suction group. Similarly, the low temperature suction header 80, the suction line 85, and the low temperature compressor assembly 20 will be referred to as the low temperature suction group.

With continued reference to FIG. 1, the refrigeration system 10 further includes a bypass line interconnecting the medium temperature suction main 25 and the low temperature suction main 30 (e.g., fluidly connecting the suction headers 70, 80, or the suction lines 75, 85). An electronic crossover or bypass valve 90 is positioned in the bypass line to control crossover flow between the medium and low temperature suction headers 70, 80 and, therefore, control crossover flow to the medium and LT compressor assemblies. The illustrated crossover valve 90 can be a stepper valve, an electronic pressure-regulating valve, or a solenoid valve that can be electronically controlled by a controller 95. As explained in detail below, the controller 95 can control or modulate the valve 90 between an open position and a closed position (and any partially open position) to i) provide load shifting to maintain load distribution across the MT and LT compressor assemblies (e.g., shift load to the LT compressor assembly 20 to maintain minimum run time on the LT compressor assembly 20), ii) provide redundant emergency backup control when the LT compressor assembly 20 is shutdown (e.g., due to failure detected by a current sensing relay, or other reasons), and/or iii) provide an incremental capacity step (capacity modulation) for the MT compressor assembly 15. More generally, the valve 90 can be modulated based on various conditions experienced by one or more components of the refrigeration system 10, including the medium and LT compressor assemblies.

I. Crossover Valve as Load Shifting Valve; Supporting LT Compressor

Figure 2:
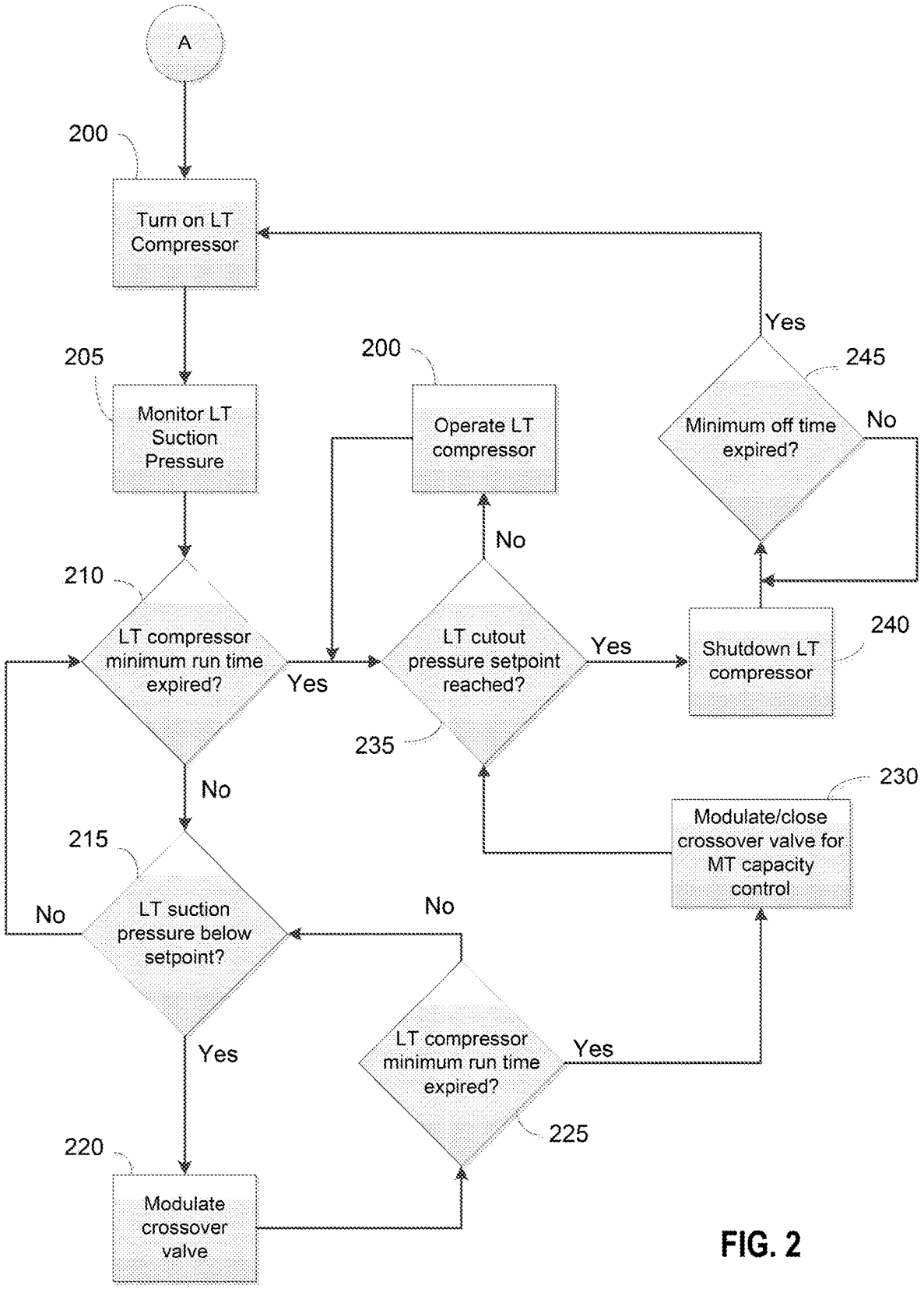
FIG. 2 is a flowchart illustrating an exemplary process for shifting load from the medium temperature suction group to the low temperature suction group to support the low temperature compressor group.

When the load on the low temperature suction group has diminished to the point where the LT compressor is oversized, there are situations where it is necessary to keep a single LT compressor running. The time period to keep the LT compressor running is defined as the minimum run time for the LT compressor. In one example, and with reference to FIG. 1, the refrigeration system 10 includes a single LT compressor and two suction transducers 100 (e.g., sensors) connected to the low temperature suction header 80 and the medium temperature suction header 70 (it will be appreciated that the transducers 100 can be coupled to the suction lines 75, 85 in another embodiment). Referring to FIG. 2, when the LT compressor turns on (Step 200), the controller 95 monitors the pressure in the low temperature suction header 80 (Step 205). If the controller 95 determines that the minimum run time has not expired ("No" at Step 210), the controller 95 determines whether the low temperature suction header pressure drops below the setpoint dead band (Step 215). If the suction header pressure has not dropped below the setpoint dead band ("No" at Step 215), the process returns to Step 210. If the controller 95 determines that the suction header pressure has dropped below the setpoint dead band ("Yes" at Step 215), the controller 95 modulates the crossover valve 90 open to shift refrigerant load to the low temperature suction group (Step 220). The crossover valve 90 modulates between fully closed (0%) to fully open (100%) to allow the LT compressor the appropriate load to continue running while within the minimum run time. In this example, the amount of refrigerant mass flow to the LT compressor can be modulated or terminated when not needed.

Upon reaching the cut-in pressure setpoint and the minimum off time has been reached, the LT compressor will start and run until the minimum run time has expired. The crossover valve 90 can be controlled (e.g., modulated) by the controller 95 to shift medium temperature capacity to the LT compressor to ensure the LT compressor has adequate load to prevent pulling the low temperature suction pressure too low and hitting the cutout point on the low pressure control, and to avoid putting the system in an undesirable vacuum state. The controller 95 continues to monitor the suction pressure at Step 215 prior to expiration of the minimum run time ("No" at Step 200) to determine whether the suction pressure is below the setpoint. After the minimum run time has expired ("Yes" at Step 225), the controller 95 adjusts the crossover valve 90 back to being a capacity control valve for the MT compressor assembly 15 (Step 230). The controller 95 can close the crossover valve 90 if demands of the refrigeration system 10 require closure to maintain normal refrigerating operation (refrigeration mode). If the suction pressure on the low temperature suction group reaches a desired or predetermined cutout setpoint ("Yes" at Step 235), the controller 95 cycles off the LT compressor and starts the minimum off time count (Step 240). The controller 95 prevents restarting of the LT compressor ("No" at Step 245) until the minimum off time has expired ("Yes" at Step 245). The minimum off time can be overridden by the controller 95 if the LT compressor is in an alarm state. After the minimum off time has expired (or when the LT compressor is in an alarm state), the controller 95 repeats the process by turning on the LT compressor based on refrigerant demand in the low temperature display case(s).

Returning to Step 210, if the controller 95 determines that the minimum run time has expired ("Yes" at Step 210), the controller 95 determines whether the cutout pressure setpoint has been reached (Step 235). If the cutout pressure setpoint has not been reached ("No" at Step 235), the controller 95 continues to operate the LT compressor (Step 250). When the controller 95 determines that the cutout pressure setpoint has been reached ("Yes" at Step 235), the controller 95 shuts down the LT compressor (Step 240).

During a defrost cycle, the controller 95 can control the crossover valve 90 to ensure the LT compressor has adequate load to prevent pulling the low temperature suction pressure to or below the low pressure control setpoint anytime the LT compressor is within the predetermined minimum run time. After the minimum run time has expired, the crossover valve 90 will no longer provide load shedding and the compressor will be allowed to cycle off based on refrigerant demand. Refrigeration using the LT compressor assembly 20 resumes after defrost has terminated.

Continuing with this example, the MT compressor assembly 15 includes a lead or primary MT compressor (e.g., a digital compressor) and a secondary MT compressor, each of which has a minimum run time and a minimum off time. In this example, it is preferred that the primary MT compressor is the first compressor turned on by the controller 95 and the last compressor turned off by the controller 95.

When the primary MT compressor ramps down to 10% capacity, the controller 95 will operate the primary MT compressor on a delay (e.g., for a predetermined delay time) to prevent prematurely staging off the compressor. Minimum off times are over-ridden by the controller 95 if there is an alarm state. For example, the primary MT compressor can be controlled by the controller 95 using a minimum off time that is limited to two minutes.

The controller 95 controls operation of the primary MT compressor through a digital pulse-width modulation (PWM) cycle. In one embodiment, the primary MT compressor is controlled for a predetermined PWM cycle (e.g., a twenty second interval started in the de-energized or loaded state, ending in an energized or unloaded state with a proportional-integral-derivative (PID) loop rate. For example, the rate can be approximately between a 10 second window, +/−5 seconds. The change in capacity per step should be limited to 25% per PWM cycle. For example, if the last cycle is at 50%, (10 seconds loaded/10 second unloaded), the next cycle is limited to a min of 25% (5 seconds loaded/15 second unloaded) or 75% (15 second loaded/5 seconds unloaded). An exception to this cycling may occur when an additional compressor comes online.

The primary MT compressor ramp-up is controlled by the controller 95 through a filter suction pressure and PID loop based on the dead band set point for the medium temperature suction group. The primary MT compressor will be allowed to run down to 10% capacity. Any capacity below 10% will cycle off the primary MT compressor for the minimum time off. If the average capacity falls below the primary compressor minimum capacity for more than the primary MT compressor low capacity maximum time, the primary MT compressor will turn off and time out for the compressor minimum time off. Under normal staging, the secondary MT compressor will not start unless the primary MT compressor is either running or in an alarm state.

When the primary MT compressor reaches 100% capacity and is not within the setpoint dead band, the controller 95 will first try to utilize the crossover valve 90 to provide some incremental capacity before determining to turn on the secondary compressor. To prepare for the stage, the primary MT compressor ramps down to 10% capacity just prior to starting or initializing the secondary compressor. The primary MT compressor will remain at 10% for a time period (e.g., 1 minute) to allow for the medium temperature suction group to stabilize. After that, the primary MT compressor is ramped up by the controller 95 as needed to meet the refrigerant demand. If the primary MT compressor runs, on average, below the primary compressor low capacity setpoint for more than the primary compressor low capacity max time, or goes below 10%, the controller 95 will turn off the secondary MT compressor and ramp up the primary MT compressor to 100%. If the secondary compressor has not reach the secondary compressor minimum run time, the secondary compressor will continue to run with the primary MT compressor at 10% until the secondary compressor minimum run time has expired.

After the setpoint has been reached, the primary MT compressor will begin ramping down. After the demand reaches a point approximately at or below 10%, the controller 95 will cycle off the secondary compressor. Thereafter, the primary MT compressor will immediately ramp to 100% (e.g., for a period of 1 minute) to allow for the system to stabilize, and then the primary MT compressor will be ramped down as needed based on the requirements of the refrigeration system 10. The secondary compressor will remain off for the minimum off time unless the primary MT compressor enters an alarm state. When the primary MT compressor ramps down to 10%, the controller 95 will delay for the primary MT compressor minimum capacity delay time to prevent prematurely staging off a compressor.

The controller 95 manages the medium temperature suction group such that minimum run times will be ignored when the system goes into defrost mode and the medium temperature suction pressure drops below the suction pressure setpoint. Normal cycling strategy will be followed otherwise. If only the primary MT compressor is running when the medium temperature defrost occurs and the load is below 30%, the controller 95 will turn off the primary MT compressor, open the capacity crossover valve 90, and run the refrigeration system 10 using the low temperature suction group. The LT compressor must be in operation to perform this function.

The minimum run time load shifting provides a controlled way to ensure adequate run time on the LT compressor under light load or transient conditions. In circumstances when the LT compressor is brought online and the load to too light to support the compressor mass flow or capacity at the given condition, which can be indicated by the suction pressure dropping beyond a threshold outside the set point dead band, the controller 95 will begin to open the crossover valve 90. Opening the crossover valve 90 bleeds over high pressure from the medium temperature suction group. The controller 95 will open the crossover valve 90 incrementally until the suction pressure is brought back within the setpoint dead band. After the suction pressure is within the setpoint dead band, the controller 95 will maintain the crossover valve 90 in the incremental open position until the minimum run time limit has expired. Upon expiration of the run time limit, the controller 95 closes the crossover valve 90, which permits the low temperature suction pressure to react solely to the mass flow of the LT compressor. If the suction pressure goes outside the setpoint dead band, the LT compressor is cycled off by the controller 95. The controller 95 will prevent LT compressor from restarting until the minimum off time has been reached.

II. Crossover Valve for Emergency Redundant Control to support LT Load

Figure 3:
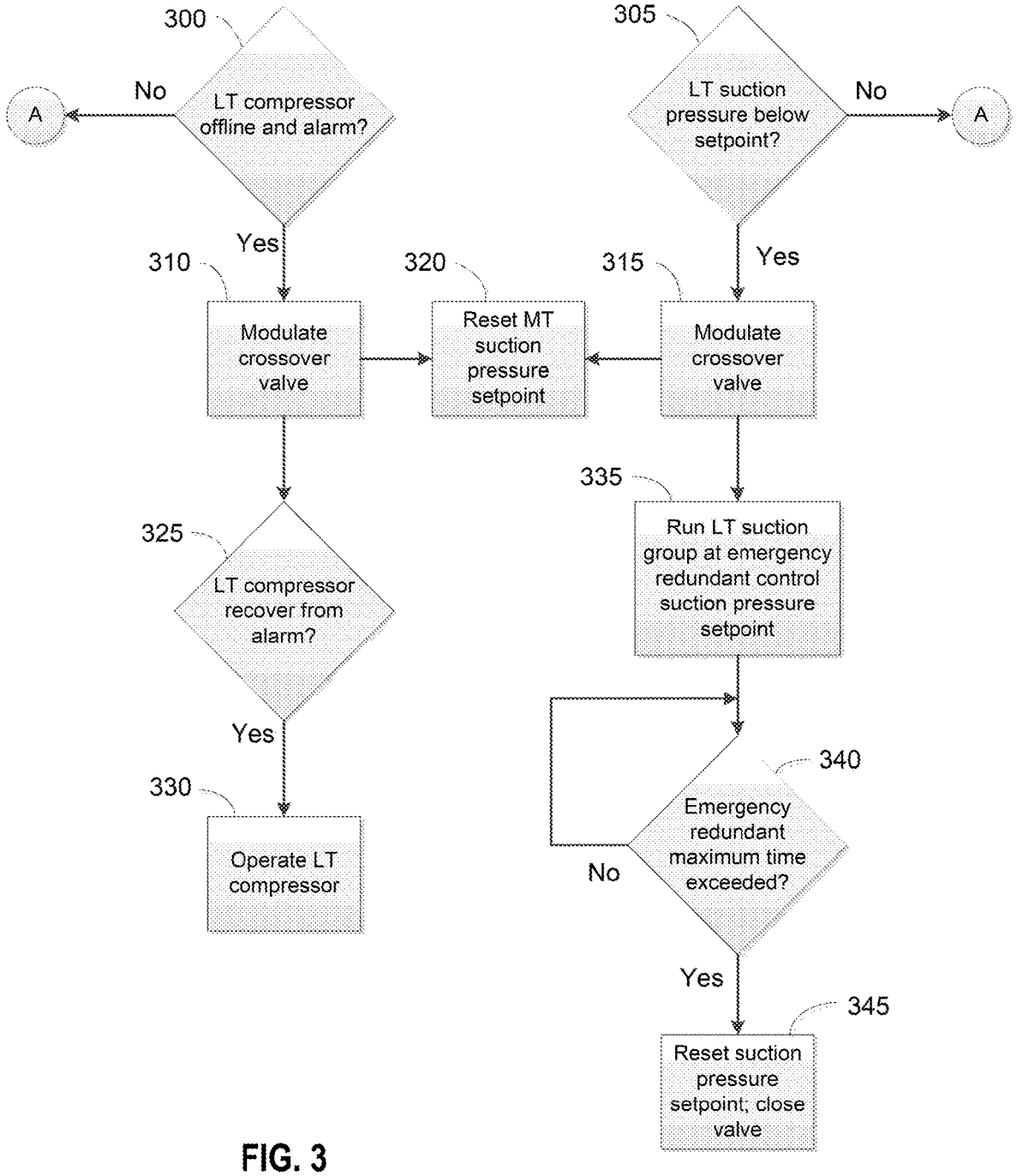
FIG. 3 is a flowchart illustrating an exemplary process for emergency redundant control to support the low temperature load.

With reference to FIG. 3, the controller 95 prioritizes control of the crossover valve 90 so that the crossover valve 90 provides emergency redundant control for the low temperature suction group. If emergency redundant control is not required ("No" at Steps 300, 305 in FIG. 3), the valve 90 can provide load shift capability to maintain minimum run time on the LT compressor(s) (see FIG. 2), or incremental capacity control (see FIG. 4).

Referring to FIG. 3, in the event the LT compressor is offline and in an alarm state ("Yes" at Step 300), or if the suction pressure reaches a corresponding pressure above the emergency redundant control suction pressure setpoint ("Yes" at Step 305), the controller 95 manipulates the crossover valve 90 so that it is 100% open (Step 310 or Step 315, respectively). In addition, the suction pressure setpoint on the medium temperature suction group is reset by the controller 95 to an emergency redundant control suction pressure setpoint (Step 320). This mode is only used in emergency situations and the LT compressors should be serviced within 24 hours.

The system recovers in the following exemplary scenarios. In one scenario, if the LT compressor is off and in an alarm state ("Yes" at Step 300), then any LT compressor that recovers from alarm and is able to run ("Yes" at Step 325) will provide for recovery (Step 330). In another scenario, if the controller 95 determines that the low temperature suction pressure reaches the emergency redundant control suction pressure setpoint to enter redundant control mode ("Yes" at Step 305), then the system is run at the emergency redundant control suction pressure setpoint for the emergency redundant control maximum time (Step 335). After the maximum time has been exceeded ("Yes" at Step 340), the suction pressure setpoints are adjusted back to normal operation and the crossover valve 90 is closed (Step 345). The emergency redundant control initiation logic in the controller 95 will be disabled at this point. The logic in the controller 95 that initiates the emergency redundant control mode is re-initiated when the low temperature suction pressure reaches the low temperature suction setpoint.

In general, the controller 95 will prioritize emergency redundant control over, and disable, the minimum run time load shift operation (described in section I above) and incremental capacity stage operation (described in section III below). The minimum run time load shift initiates when the low temperature suction pressure drops below the lower dead band of the low temperature suction pressure set point and the minimum run time timers for all running LT compressors have not expired. The system recovers when the minimum run time timers have expired for all LT compressors. Incremental capacity staging for the medium temperature suction group is bypassed via control from the controller 95 during the minimum run time load shift. Furthermore, the controller 95 disables the minimum run time load shift when emergency redundant control is needed.

III. Crossover Valve and Incremental MT Compressor Control

Figure 4:
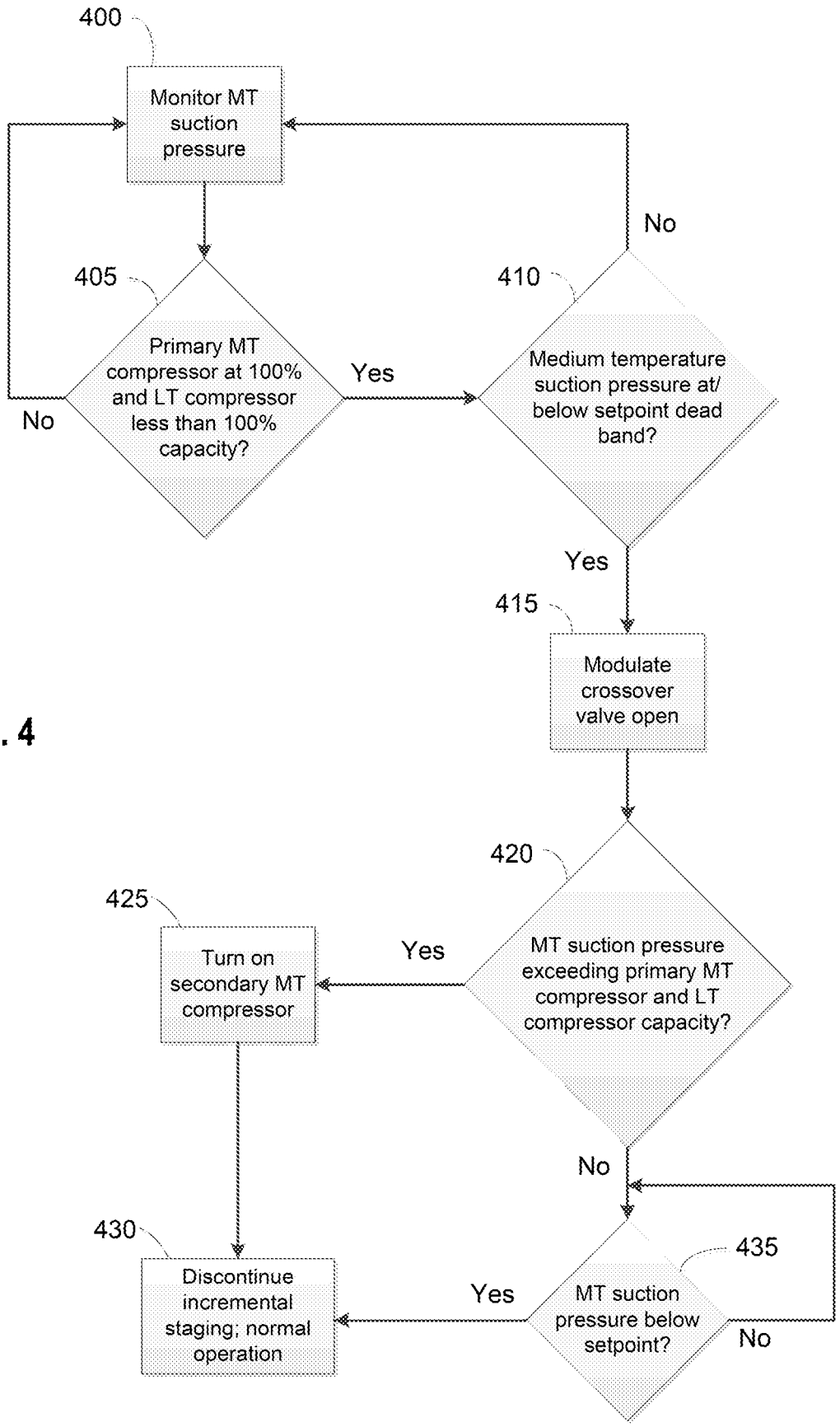
FIG. 4 is a flow chart illustrating an exemplary process for incremental capacity control for the medium temperature compressors.

The crossover valve 90 can be controlled by the controller 95 to provide a small or incremental capacity step between the first MT compressor and the second MT compressor through load shedding to the low temperature suction group. With reference to FIG. 4, the controller 95 monitors the pressure of each suction group and the staging of each MT compressor (Step 400). In the event the primary MT compressor (e.g., a digital compressor) is running at 100% capacity and the low temperature suction group is in a state where it can accept additional load ("Yes" at Step 405), the controller 95 modulates the crossover valve 90 to an open position to allow crossflow to the LT suction group (Step 415) subject to the medium temperature suction pressure relative to the setpoint dead band (Step 410). That is, some of the medium temperature load shifts from the medium temperature suction group to low temperature suction group. The load shifting decreases the medium temperature load on the medium temperature suction group an incremental amount, which alleviates the need to stage the secondary MT compressor to meet the medium temperature load requirements.

The controller 95 initiates incremental control in the medium temperature suction group by providing an incremental capacity step between the primary MT compressor and the secondary compressor. When the primary MT compressor reaches 100% capacity and medium temperature suction pressure is not above the setpoint dead band ("Yes" at Step 410), the controller 95 will first utilize the crossover valve 90 to provide incremental capacity via the low temperature suction group before determining whether to initiate or turn on the secondary compressor ("Yes" at Step 420). In this control situation, the LT compressor must be in the on position to support the incremental capacity stage for the medium temperature suction group. The controller 95 does not force the LT compressor to turn on to provide incremental capacity. That is, if the LT compressor is off, additional capacity is provided by the secondary compressor (Step 425).

The incremental staging or control initiates when the medium temperature suction group has only the primary MT compressor on and running at 100%, and the medium temperature suction pressure is above the medium temperature suction pressure setpoint upper dead band limit after the minimum run time expires for the primary MT compressor. The incremental staging by the controller 95 recovers (Step 430) when the secondary compressor is turned on due to the medium temperature suction pressure being above setpoint dead band for 30 continuous seconds after the capacity staging has occurred (Step 425), or if the medium temperature suction pressure drops below the medium temperature suction pressure setpoint upper dead band limit for 30 continuous seconds ("Yes" at Step 435). The incremental staging is disabled by the controller 95 when the minimum run time load shift is needed (see section I), or when the controller 95 determines that emergency redundant control is needed (see section II). In general, the controller 95 forces the crossover valve 90 closed in the event of any suction transducer failure.

Although the invention is described with reference to its application in refrigerated merchandisers, it will be appreciated that the refrigeration system 10 and method of control described herein will have other applications. Also, it should be appreciated that the controller 95 can include and implement different processes and logic to achieve the functionality described herein.

The refrigeration system 10 with the electronic crossover valve 90 positioned in bypass line between medium temperature and low temperature suction headers 70, 80 provides control of synchronization between the medium temperature and low temperature suction groups, and reduces or eliminates the need for adjustments after prolonged operation and to accommodate seasonal weather changes. The bypass control also controls short-cycling of the medium and LT compressors, provides additional staging for the medium temperature portion of the refrigeration system 10, supports emergency redundant capacity, minimizes wide pressure swings during operation under light loads, improves design load flexibility, and eliminates expensive digital compressors that are common in existing systems.

As described in detail above, in the event of a failure of the LT compressor (e.g., detected by a current sensing relay), the low temperature load is shifted over to the medium temperature suction group to allow some level of refrigeration to the low temperature circuit. At the same time, the pressure setpoint for the medium temperature suction group is set lower by the controller 95 to better maintain the temperature in the low temperature circuit.

In general, the controller 95 actively monitors the LT compressor for failure, and adjusts the setpoint for the medium temperature suction group to a lower setting when additional capacity is needed in the low temperature suction group. In addition, the amount of refrigerant mass flow to the medium temperature suction group can be modulated and controlled via the controller 95 and the crossover valve 90, and after a period of time (e.g., 24 hours), the refrigeration system 10 can recover from this mode and run again with a normal suction pressure setpoint and the emergency redundant logic disabled.

Compared to existing mechanically-controlled systems, the electronically-controlled system described herein provides better load matching capability based on the responsiveness of the electronic crossover valve 90 and the variable load distribution and ability to change the pressure setpoint that can be accomplished by the crossover valve 90. In addition, the controller 95 and, in particular, control of the crossover valve 90 provides emergency redundant control when one of the suction groups experiences a failure, and incremental staging for the MT compressors when needed.

Various features and advantages of the invention are set forth in the following claims.

The invention claimed is:

1. A method of controlling a refrigeration system including a medium temperature refrigeration load and a low temperature refrigeration load, the refrigeration system further including a medium temperature suction group having a suction header and a medium temperature compressor assembly operable at a first suction pressure setpoint in a normal refrigeration mode, and a low temperature suction group having a suction header and a low temperature compressor assembly operable at a second suction pressure setpoint in a normal refrigeration mode, the method comprising:

selectively bypassing refrigerant between the medium temperature suction group and the low temperature suction group via a bypass line using an electronic valve positioned in the bypass line;

controlling flow of refrigerant between the medium temperature suction group and the low temperature suction group via a controller communicatively coupled to the electronic valve, the controller further communicatively coupled to a first sensor in communication with the medium temperature suction group to detect a medium temperature suction pressure of refrigerant contained in the medium temperature suction group, and a second sensor in communication with the low temperature suction group to detect a low temperature suction pressure of refrigerant contained in the low temperature suction group; and modulating the electronic valve at any position between a closed position and a full open position to vary an amount of refrigerant flow between the medium temperature suction group and the low temperature suction group in response to determining, via the controller, one or both of a state of the medium temperature suction group and a state of the low temperature suction group using one or both of the first sensor and the second sensor.

2. The method of claim 1, wherein modulating the electronic valve selectively provides refrigerant to the low temperature compressor assembly to achieve a minimum run time for the low temperature compressor, to achieve emergency redundant control of the low temperature compressor assembly, or to achieve incremental staging capacity for the medium temperature compressor assembly.

3. The method of claim 1, further comprising:

monitoring the low temperature suction pressure;

determining that a minimum run time associated with the low temperature compressor assembly has not expired;

determining that the low temperature suction pressure has dropped below a setpoint dead band; and modulating the electronic valve to one or more open positions to shift refrigerant load to the low temperature suction group in response to the determination that the minimum run time has not expired and the determination that the low temperature suction pressure has dropped below a setpoint dead band.

4. The method of claim 3, wherein the electronic valve is modulated until a minimum run time associated with the low temperature compressor assembly has expired.

5. The method of claim 3, further comprising shutting off the low temperature compressor assembly in response to the controller determining that a cutout pressure setpoint has been reached after expiration of the minimum run time.

6. The method of claim 3, further comprising closing the crossover electronic valve in response to the controller determining that the medium temperature load requires additional refrigeration.

7. The method of claim 1, further comprising:

determining that the low temperature compressor assembly is offline and in an alarm state or determining that the second suction pressure has reached a pressure above a first emergency redundant control suction pressure setpoint;

modulating the electronic valve to the full open position in response to either determination; and resetting the first suction pressure setpoint to a second emergency redundant control suction pressure setpoint in response to either determination.

8. The method of claim 7, further comprising:

determining that a maximum time has been exceeded for emergency redundant control; and resetting the first second suction pressure setpoints to normal operation in response to determining that the maximum time has been exceeded for emergency redundant control; and disabling emergency redundant control via the controller in response to the resetting step.

9. The method of claim 1, wherein the medium temperature compressor assembly includes a primary compressor and a secondary compressor, the method further comprising:

determining, via the controller, that the primary compressor is at 100% capacity and the low temperature suction group is at less than 100% capacity;

determining that the medium temperature suction pressure is above a first suction pressure setpoint upper dead band limit after a minimum run time expires for the primary compressor;

modulating the electronic valve to a variable open position to allow crossflow of refrigerant from the medium temperature suction group to the low temperature suction group to decrease a load on the medium temperature suction group an incremental amount in response to the determination that the primary compressor is at 100% capacity and the low temperature suction group is at less than 100% capacity and the determination that the medium temperature suction pressure is above the first suction pressure setpoint upper dead band limit after the minimum run time.

10. The method of claim 9, initiating the secondary compressor when the primary compressor is at 100% capacity only in response to i) the low temperature suction group being unable to take on additional capacity, or ii) the low temperature suction group is offline.

11. A refrigeration system comprising:

a medium temperature refrigeration load;

low temperature refrigeration load;

a medium temperature suction group including a suction header and a medium temperature compressor assembly operable at a first suction pressure setpoint in a normal refrigeration mode;

a low temperature suction group including a suction header and a low temperature compressor assembly operable at a second suction pressure setpoint in a normal refrigeration mode;

a first sensor in communication with the medium temperature suction group to detect a medium temperature suction pressure of refrigerant contained in the medium temperature suction group;

a second sensor in communication with the low temperature suction group to detect a low temperature suction pressure of refrigerant contained in the low temperature suction group;

a bypass line positioned between and selectively fluidly connected to the medium temperature suction group and the low temperature suction group;

an electronic valve positioned in the bypass line to control flow of refrigerant between the low temperature suction group and the medium temperature suction group; and a controller in communication with the electronic valve, each of the medium temperature compressor assembly and the low temperature compressor assembly, and the first and second sensors, the controller programmed to modulate the electronic valve at any position between a closed position and a full open position based on one or both of a state of the medium temperature suction group and a state of the low temperature suction group determined by the controller via one or both of the first sensor and the second sensor, wherein control of the electronic valve by the controller selectively provides varying amounts of refrigerant flow between the medium temperature suction group and the low temperature suction group in response to determining the state of the medium temperature suction group and the low temperature suction group.

12. The refrigeration system of claim 11, wherein the controller is programmed to open the electronic valve to the full open position in response to the controller determining the at least one low temperature compressor is in an alarm state and offline.

13. The refrigeration system of claim 11, wherein the controller is programmed to open the electronic valve to the full open position in response to the controller determining the suction pressure has reached a pressure associated with an emergency redundant control suction pressure setpoint, and wherein the controller is programmed to adjust the first suction pressure setpoint to a lower setpoint.

14. The refrigeration system of claim 13, wherein controller is programmed to override the second suction pressure setpoint and to operate the at least one low temperature compressor at the emergency redundant control suction pressure setpoint for a maximum run time, and wherein the controller resets the low temperature compressor to the second suction pressure setpoint upon expiration of the maximum run time.

15. The refrigeration system of claim 11, further comprising an emergency redundant control mode, a minimum run time load shift mode, and an incremental capacity stage mode, and wherein the controller is programmed to prioritize the emergency redundant control mode.

16. The method of claim 1, wherein the modulating step includes crossover flow of refrigerant between the medium temperature suction group and the low temperature suction group.

* * * * *